US005078564A

United States Patent [19]

Zago

[11] Patent Number: 5,078,564

[45] Date of Patent: Jan. 7, 1992

[54] SEAMING EQUIPMENT FOR SECURING THE ENDS OF TINS, CANS AND SIMILAR METAL CONTAINERS, IN PARTICULAR CANS FOR FOODSTUFFS

[75] Inventor: Ennio Zago, Portici, Italy

[73] Assignee: Wemex Italia S.P.A., Milan, Italy

[21] Appl. No.: 504,569

[22] Filed: Apr. 4, 1990

[30] Foreign Application Priority Data

Apr. 4, 1989 [IT] Italy ..... 47813A/89

[51] Int. Cl.[5] ..... B21D 51/32; B21D 51/34

[52] U.S. Cl. ..... 413/30; 72/94; 413/4

[58] Field of Search ..... 413/4, 5, , 6, 7, 30; 73/94; 53/331, 341

[56] References Cited

U.S. PATENT DOCUMENTS

| | | | |
|---|---|---|---|
| 566,701 | 8/1896 | Rowley | 72/94 |
| 1,126,699 | 2/1915 | Buhles | 413/30 |
| 1,440,143 | 12/1922 | Guenther | 413/30 |
| 1,450,418 | 4/1923 | Guenther | 413/30 |
| 4,808,053 | 2/1989 | Nagai et al. | 413/30 |

*Primary Examiner*—James G. Smith

*Assistant Examiner*—Jack W. Lavinder

*Attorney, Agent, or Firm*—Thomas R. Vigil

[57] ABSTRACT

The seaming equipment is used for interlocking and sealing the rim of a can which includes a cylindrical body enclosed at the opposite ends by respective covers. The equipment comprises a single vertical column, rotatable about its own axis; a plurality of spindles carried by the column, disposed substantially in radial formation with axes vertical and operating in conjunction with relative spring-loaded means each serving respectively to support and to clamp together one cover and the relative cylindrical body; entry conveyor means by which the cylindrical bodies and relative covers are caused to enter the column in readiness for seaming operation; exit conveyor means by which the cylindrical bodies and covers are caused to exit the column upon completion of the seaming operations; at least three work stations arranged around the single column and encountered in sequence between the entry conveyor means and the exit conveyor means, through which the spindles and the relative clamping means are rotated by the column, revolving about their respective vertical axes, so as to interlock and compress together the edge of the cover and the lip of the cylindrical body.

19 Claims, 2 Drawing Sheets

SEAMING EQUIPMENT FOR SECURING THE ENDS OF TINS, CANS AND SIMILAR METAL CONTAINERS, IN PARTICULAR CANS FOR FOODSTUFFS

BACKGROUND of the INVENTION

The present invention relates to seaming equipment for interlocking and sealing the rims of tins, cans and similar metal containers, in particular cans as utilized for foodstuffs.

The prior art of fabricating tin cans and similar metal containers which have a cylindrical body enclosed at each end, has long embraced the practice of fashioning a cylinder from a discrete length of strip metal rolled into a tube and welded along the two butted or overlapping longitudinal edges, then applying a base, filling the resulting container with a given product, and finally capping the open top with a lid. The application of the two end covers, i.e. the base and the lid, is effected in general utilizing seaming techniques well known to those skilled in the art.

In practice, seaming comprises folding the outer edge of the end cover, whether base or lid, and the endmost lip of the cylinder, in such a way that the two interlock.

Further operations may be envisaged, such as the application of a sealing compound to the end pieces in order to render the seam hermetic and obtain a fluid-tight container capable both of preventing any escape of the contents and of disallowing any infiltration of air that would cause the foodstuff to deteriorate rapidly.

Seaming operations currently are effected using a type of machine of which the essential components comprise at least one vertical column, rotatable about its own axis, and a plurality of spindles with respective spring-loaded clamps carried by the column and rotatable both about the column axis and about their own vertical axes.

The differences discernible in such machines lie essentially in the parts used to produce a seaming action; substantially three types of operation are commonly encountered.

A first system utilizes two columns, the first of which used to draw the metal, the second to roll the seam, and is suitable for working metals of thin gage (>0.14 mm approx) and high temper (DR8, DR9 approx), but gives only limited operating speed and poor overlap of the joined edge and lip. In a machine with two columns, moreover, one has the requirement for means by which to transfer the cans from one column to the other.

A second system exploits one column only to effect two rolled seaming passes, though in this instance, difficulties are encountered when working with cans of small diameter, and with the thin gage and high temper metals which tend to be preferred currently by the industry. What is more, the need to operate with small diameter rollers, hence with a localized rather than a continuous compressive force, results in the formation of kinks that necessarily inhibit a thorough compaction of the interlocked seam.

The third system requires two columns and involves two steps both of which are die-seaming operations. In addition to the dimensional drawbacks inherent in such a system, there are those of the machine's complexity in construction and limited operating speed, and worse, its inability to invest the edge and lip with a proper compressive force, applied, that is, from inside the circumference of the seam as well as out, which would improve the seal.

An additional drawback common to all the systems mentioned is the poor interlock between the edge and lip, hence the limited guarantee of a hermetic seal afforded by the finished can.

The object of the present invention is to provide equipment of the type above, capable of carrying out a faultless seaming operation even on cans of small diameter and/or fashioned from thin gage and high temper metals.

A further object of the invention is to provide equipment of compact dimensions able to operate at a rational and high rate of output, and with this end in view, embodied as a single column surrounded by a plurality of work stations.

SUMMARY of the INVENTION

The stated objects are fully realized in seaming equipment according to the invention.

Such equipment comprises a minimum of three work stations, of which at least two are dies arranged in immediate succession and designed to effect at least two distinct and coordinated operations and the third a roller; all are disposed about a single column and encountered in sequence between an entry conveyor and an exit conveyor.

Each of the first two stations comprises a sector shaped die of which the face directed toward the column affords a profiled groove; the dies occupy fixed positions in relation to the column, whilst their distance from the column axis is adjustable according to the diametral dimensions of the cans for seaming.

Equipment according to the invention affords the advantages of avoiding the formation of kinks at the first die, deepening the interlock between the overlapping edges with the second die, and ensuring compaction of the overlap with the final roller.

A further advantage of equipment according to the invention is that it is simple and practical to use, and uncostly by virtue of its uncomplicated construction.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
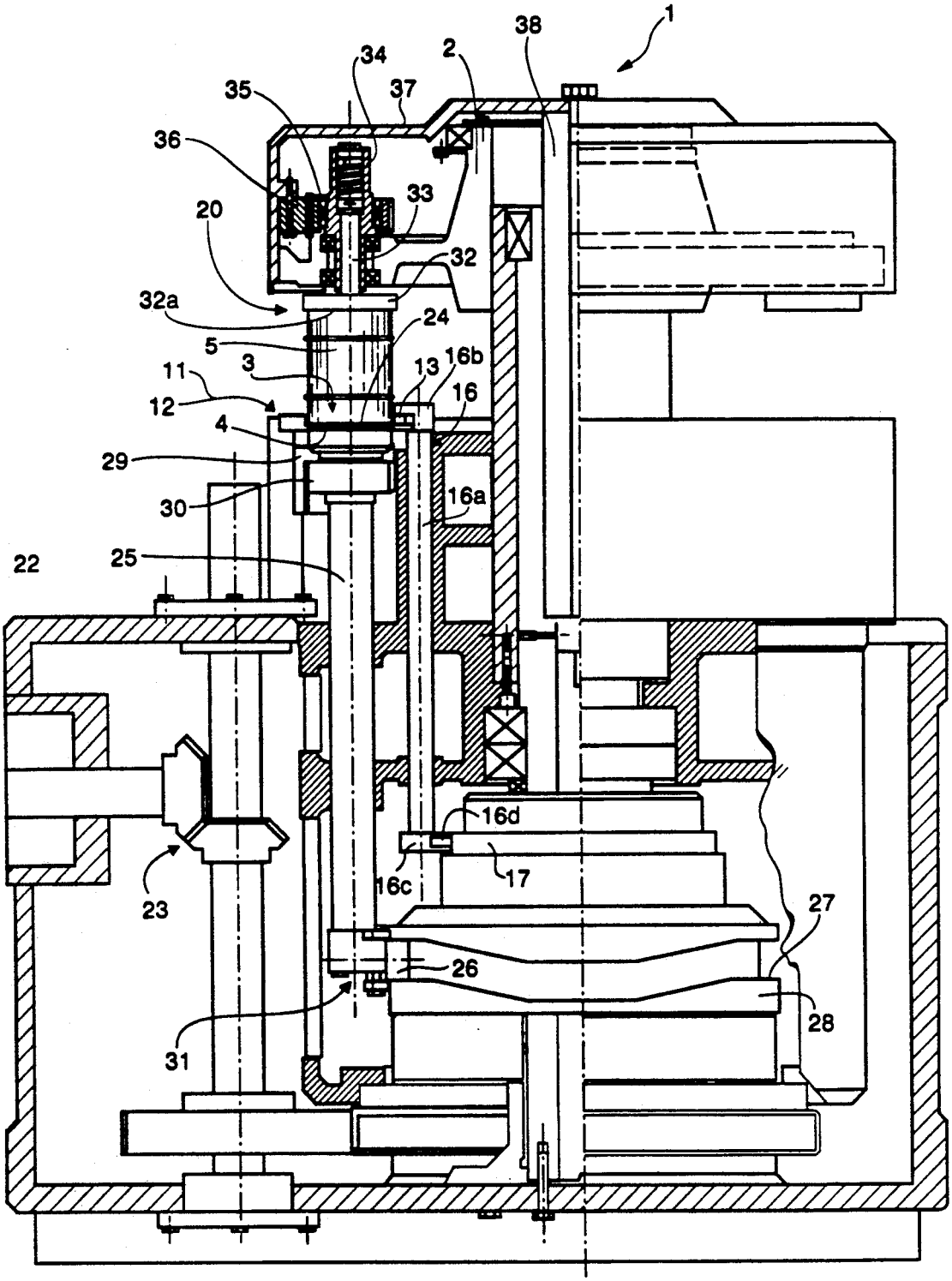
FIG. 1 illustrates seaming equipment according to the invention, in axial section.
Figure 4:
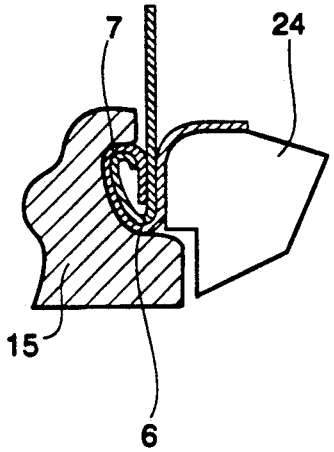
FIGS. 3, 4 and 5 are fragmentary vertical section views showing the edge of a can in contact with a groove of the equipment in three different circular positions of the can as the can moves clockwise around a column of the seaming equipment.
Figure 5:
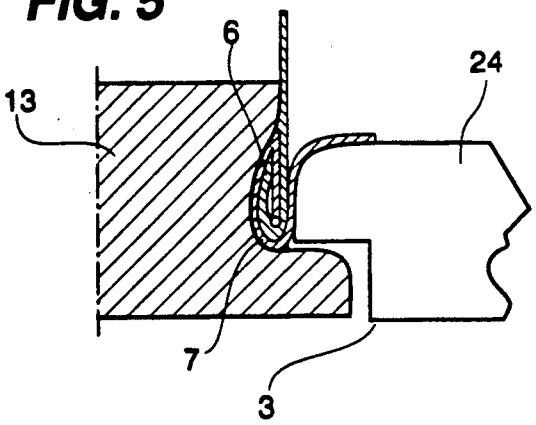

With reference to the drawings, 1 comprehensively denotes seaming equipment for the fabrication of tins, cans and similar metal containers comprising a cylindrical body 5 enclosed by end covers 4; such equipment comprises a column 2, a plurality of spindles 3 with respective spring-loaded clamping means 20, and a given number of work stations. The column 2 is supported by a frame 22, and set in rotation about its own vertical axis by drive means (not illustrated) through a mechanical linkage 23. The spindles 3 are mounted to the column 2, and in the embodiment illustrated, where it will be seen to be the base end cover 4 that is seamed to the cylindrical body 5, each consists substantially in a horizontal plate 24 rigidly associated with the top end of a vertical shaft 25 carried slidably and rotatably by the column 2. Cam follower means keyed to the bottom end of the shaft 25 comprise a freely revolving roller 26 that engages in the groove 27 of a cam 28 rigidly associated with the frame 22. The shaft 25 is supported vertically by the cam 28 and follower 26, and caused by them to move in the vertical direction substantially between a raised limit position, in which the end cover 4 and the cylindrical body 5 are afforded support during the seaming operation, and a lowered limit position in which replacement of the two components is enabled. 29 and 30 denote a meshing gear pair, the former an internal gear rigidly associated with the frame 22, the latter a wheel keyed to the shaft 25. The tooth length of the internal gear 29 is greater than that of the keyed gear 30, by an amount at least equal to the axial travel of the shaft 25, in order to ensure continued meshing contact even during the vertical movement of the shaft 25. In practice, this difference in length will also take account of shift induced by axial positioning means 31 located between the shaft 25 and the follower 26, which serve to adjust the travel height of the plate 24. The diameter of the plate 24 is smaller than the internal diameter of the cylindrical body 5, so as to permit of inserting the plate into the can and exploiting it as an immovable bolster against which the compressive seaming force can be applied. Spring-loaded clamp means 20 comprises a horizontal plate 32 rigidly associated with the bottom end of a shank 33 located above and disposed in coaxial alignment with the spindle shaft 25. The shank 33 is ensheathed by a freely revolving sleeve 34 carried by the column 2, and axially slidable in relation thereto; a spring, loaded internally of the sleeve 34, serves to bias the shank 33 in the downwards direction. The sleeve 34 also carries a keyed gear 35, in mesh with an internal gear 36 that is rigidly associated with a bell housing 37 mounted to the top of a pillar 38, the pillar in its turn being rigidly associated with the frame 22 and accommodated by the column 2. The plate 32 of the spring-loaded clamp mechanism thus embodied is of diameter greater than the internal diameter of one cylindrical body 5, and affords a centralizing spigot **32*a* directed downward toward the spindle 3, of which the diameter is less than the internal diameter of the cylindrical body 5**.

Figure 2:
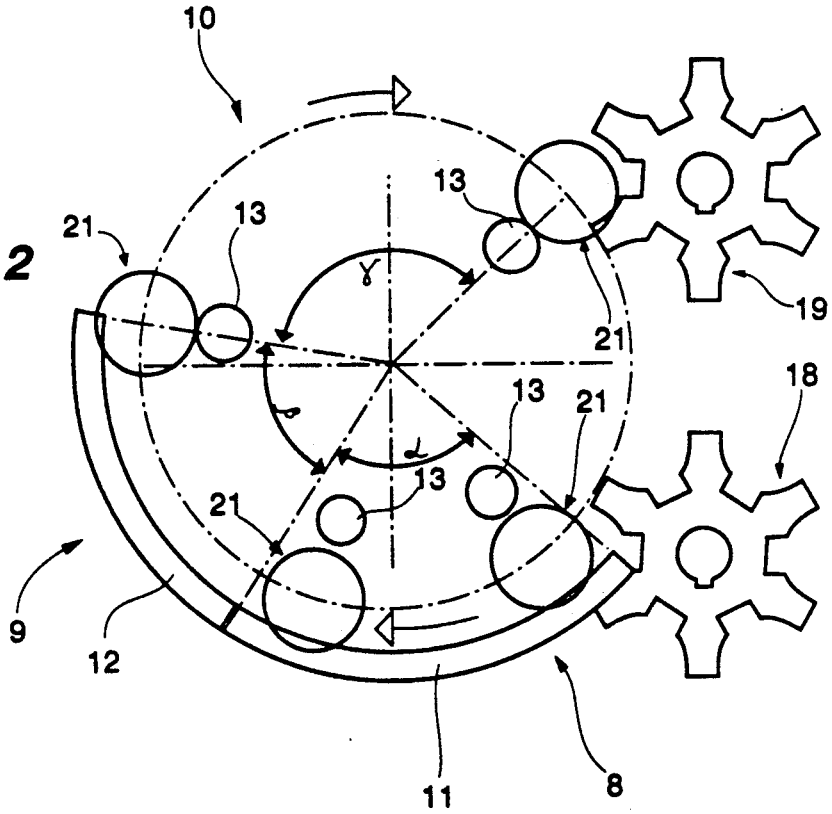
FIG. 2 is a schematic plan view of the equipment, in conjunction with cross sections illustrating the step of the seaming operation which takes place at each of the work stations.
Figure 3:
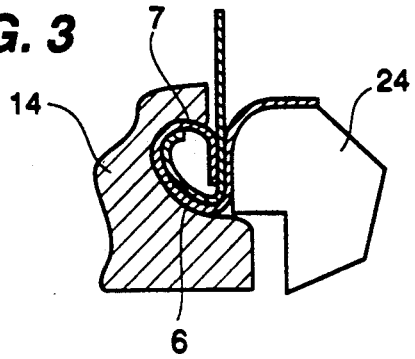

18 and 19 denote means by which single cylindrical bodies 5 and relative covers 4 are carried onto and away from the column, respectively; such means are illustrated schematically in the plan of FIG. 2 as entry and exit star wheel conveyors.

Equipment 1 according to the invention comprises one column 2 only of the type thus described, and at least three work stations 8, 9 and 10 arranged around the column 2 (see FIG. 2).

At least two of these stations, denoted 8 and 9, are arranged one immediately succeeding the other and designed to effect at least two coordinated and distinct die-seaming operations, whilst the third work station 10 effects a seam-rolling operation.

In practice and for preference, according to the present invention, the division of the die-seaming step between two stations reflects a logical and effective separation of the operations implemented by the dies, as illustrated in FIG. 2 and described in the following passage, though there is nothing to prevent the coordinated operations in question from being considered as suitable for allocation to more than two work stations.

The first station 8 is located in close proximity to the entry wheel 18 and comprises a die 11 of sector shape, associated rigidly with the frame 22, of which the distance from the axis of the column 2 can be adjusted in order to suit the dimensions cf the cylindrical bodies 5 for seaming; the face of the die 11 directed in toward the column affords a groove 14 by which the edge 6 of the cover 4 and the lip 7 of the cylindrical body 5 are slidably accommodated, as shown in detail a of FIG. 2. The profile or curved face of this first groove 14 exhibits a changing radius of curvature for encouraging initial interlocking of the edge 6 and lip 7.

The second station 9 is located following the first station 8, considered in the direction of rotation of the column 2 arrowed in FIG. 2, and comprises a relative sector shaped die 12 rigidly associated with the frame 22, of which the distance from the axis of the column 2 can be adjusted according to the dimensions of the single cylindrical bodies 5; again, the face directed toward the column affords a groove 15, though in this instance exhibiting a flatter profile than that of the first groove 14 such as to ensure maximum interlock of the edge 6 and the lip 7, as shown in detail b of FIG. 2. The two circular sector or segment dies 11 and 12 encircle the axis of the column 2 and extend through respective arcs $\alpha$ and $\beta$ such that the length of the innersurface of each die 11, 12 is greater than the circumferential length of the cylindrical body 5; thus, each assembly of a cylindrical body 5 together with its relative cover 4 denoted 21 in FIG. 2, will be made to complete more than one full revolution in contact with each die 11 and 12, for example 1.5 and 1.15 revolutions, respectively. The two dies 11 and 12 can be embodied as a single sector, of which the face directed back toward the column 2 exhibits a continuous groove composed of two dissimilar profiles corresponding to those as described above for the individual dies 11 and 12, thus enabling execution of the two distinct yet coordinated die-seaming operations in succession; alternatively, the dies 11 and 12 might equally well be embodied as even more than two components connected one to the next in succession, each of which bearing a respective stretch of the requisite profile, should such an expedient prove convenient for the purposes of positioning and fixing.

The third station 10 comprises a roller 13, and extends through an angle that is made to depart from a point preceding the runout end of the second die 12 in such a way as to ensure that there is no area in which the assembly 21 remains completely uninvested by either seaming force.

In practice, use is made of one roller 13 for each spindle 3, mounted to one end of a corresponding rocker 16 carried by the column 2 and operated by an actuator 17; the rocker 16 comprises a pivotable vertical shaft **16*a* carried by the column, and two arms 16*b* and 16*c*, top and bottom, of which the top arm carries the roller 13 and the bottom arm a cam follower 16*d*. The cam follower 16*d* is biased by spring means (not illustrated) into contact with the actuator 17, which takes the form of a cam rigidly associated with the frame 22 and affording a profile such that each seam roller 13 is brought progressively into contact with the interlocked edge 6 and lip 7 while the assembly 21 is still in contact with the second die 12; accordingly, the assembly 21 remains in constant external engagement either with a die 11 or 12 and/or with the relative roller 13, and bolstered internally by the plate 24 of the spindle 3**, as the detail illustrations a, b and c illustrate.

The roller 13 remains in contact with the relative assembly 21 while the column continues to rotate through the aforementioned angle more exactly, this third angle is of width such as to ensure that the length of the arc through which the roller 13 and assembly 21 remain in contact will be at least twice the circumference of the cylindrical body 5. The roller 13 is distanced from the assembly 21 marginally before arrival at the exit wheel 19, at which point the spindle 3 is also lowered. Thus, each roller 13 accompanies the relative assembly 21 throughout its engagement with the dies 11 and 12, before entering into contact with the interlocked edge 6 and the lip 7 at a given distance (e.g. one half revolution of the assembly 21) before the second die 12 is abandoned, in order to compress and compact them against the plate 24.

Whilst the equipment is illustrated with reference to the seaming operation effected on a bottom end cover 4 and the relative cylindrical body 5, the features disclosed are equally applicable to the subsequent application of the lid to a can already filled with foodstuff requiring preservation, in which case the spindles 3, the dies 11 and 12 and the rollers 13 will be located overhead, and the spring-loaded clamp means 20 beneath.

What is claimed:

1. Seaming equipment for interlocking and sealing the rims of a tin, a can or similar metal container which includes a cylindrical body enclosed at the opposite ends by respective covers, and in particular a can utilized for foodstuffs, comprising:

a single vertical column, rotatable about its own axis;

a plurality of spindles carried by the column, disposed substantially in radial formation with axes vertical and operating in conjunction with relative spring-loaded means, each serving respectively to support and to clamp together one cover and the relative cylindrical body;

entry conveyor means by which the cylindrical bodies and relative covers are caused to enter the column in readiness for seaming operation;

exit conveyor means by which the cylindrical bodies and covers are caused to exit the column upon completion of the seaming operation at least three work stations arranged around the single column and encountered in sequence between the entry conveyor means and the exit conveyor means, through which the spindles and the relative clamping means are rotated by the column, revolving about their respective vertical axes, so as to interlock and compress together the edge of the cover and the lip of the cylindrical body;

said stations including at least two stations in uninterrupted sequence equipped with seaming dies of circular sector embodiment and designed to accomplish at least two distinct and coordinated operations in succession, of which the inner face directed toward the column affords a profiled groove, and of which the position is fixed in relation to the column and the distance from the column axis is adjustable according to the diametrical dimensions of the cylindrical body, and a third station equipped with a seam roller;

at least one roller associated with each of the spindles, each roller being carried by a relative support rotatable as one with the column about the vertical axis of the column and capable of movement together with the roller, through the agency of actuator means which are fixed in relation to the column, between a first position assumed not later than the arrival of each corresponding seamed cylindrical body and cover at the entry conveyor means, in which the roller remains distanced from the interlocking edge and lip of the cover and cylindrical body currently occupying the spindle, and a second position, assumed no later than the ultimate passage of the assembled cylindrical body and relative cover beyond the second work station, in which the roller enters into contact with the interlocked edge and lip and exerts a compressive and compacting force against the spindle.

2. The equipment of claim 1, wherein the dies of the first two work stations are embodied in a single circular sector, of which the inner face directed toward the column presents a continuous groove exhibiting two dissimilar profiles that coincide respectively with the two work stations and thus create effectively distinct grooves.

3. The equipment of claim 1, wherein the dies of the first two work stations are embodied in an uninterrupted succession of discrete sectors, and the inner face of each such sector directed toward the column presents one corresponding section of a continuous groove exhibiting two dissimilar profiles that coincide respectively with the two work stations and thus create effectively distinct grooves.

4. The equipment of claim 1, wherein each die extends through a developable distance not less than the circumference of one cylindrical body, and the roller remains in contact with the edge and the lip through a circular arc of length not less than twice the circumference of the cylindrical body.

5. The equipment of claim 1, wherein the groove of the die nearest the entry conveyor means exhibits a curved cross sectional profile of which the radius changes and is designed to induce an interlocking fold of the edge and lip, and the groove of the successive die exhibits a relatively flat cross sectional profile designed to maximize mutual penetration of the interlocked edge and lip.

6. The equipment of claim 1, wherein the spindles are positioned beneath the respective clamping means for the purpose of seaming bottom end covers to respective cylindrical bodies, and positioned above the respective clamping means for the purpose of seaming end covers to the open tops of cylindrical bodies that are closed at the bottom and filled with a given product.

7. Seaming equipment for interlocking the rim of a metal container, including a cylindrical body adapted to be enclosed at opposite ends by respective covers, with the edge of a cover, comprising;

arcuate die means disposed on an arc about a center for engaging and seaming the rim of each container with the edge of a cover;

a single vertical column rotatable about its own axis which is concentric with the center of the arc of said die means;

a plurality of spindles carried by said column, each having a vertical axis which is spaced parallel to and radially outwardly of said column axis;

at least two working area arranged around said column;

each spindle being slidable relative to said column, being rotated by said column, and being arranged to revolve about its own axis;

each of said spindles being movable on circular orbit around the axis of said column, such that, at different positions of one spindle on said orbit around said column axis, said one spindle will have different arcuate angular relationships, on said orbit around said column axis, with adjacent spindles; and each spindle being arranged to pass through said working areas while being moved on said circular orbit around said column axis as said spindle revolves about its vertical axis to effect the seaming procedure.

8. Seaming equipment of claim 7, further comprising spring-loaded clamping means including at least one clamp and operating in conjunction with said spindles, each clamping means serving, respectively, to support said clamp together with one cover and the relative cylindrical body.

9. Seaming equipment of claim 8, further comprising a centralizing spigot attached to said clamping means.

10. Seaming equipment of claim 8, wherein said spindles are positioned beneath said respective clamping means for the purpose of seaming bottom end covers to respective cylindrical bodies, and positioned above said respective clamping means for the purpose of seaming end covers to the open tops of cylindrical bodies that are closed at the bottom and filled with a given product.

11. Seaming equipment of claim 7, further comprising entry conveyor means by which said cylindrical bodies and said relative covers are caused to enter said spindle in readiness for the seaming operation and exit conveyor means by which said cylindrical bodies and covers are caused to exit said spindle upon completion of the seaming operation.

12. Seaming equipment of claim 11, wherein each of said conveyor means comprise a star wheel.

13. Seaming equipment of claim 7, wherein said at least two working areas are positioned in uninterrupted sequence and include said arcuate die means which comprise seaming dies of circular sector embodiment and which are designed to accomplish at least two distinct and coordinated operations in succession, the interface of said dies directed toward said column having a profiled groove, the position of said dies being fixed in relation to said column, and the distance of said dies from said column axis being adjustable according to the diametrical dimensions of the cylindrical body, and wherein a third working area station equipped with a seam roller is provided.

14. Seaming equipment of claim 7 wherein each assembly of a cover and a cylindrical body is arranged to stay in each of said working areas at least one full revolution of said spindle.

15. Seaming equipment of claim 7, wherein a groove of said die means nearest the entry exhibits a curved cross-sectional profile of which the radius changes and is designed to induce an interlocking fold of the edge and lip, and said groove of said successive areas of said die means exhibits a relatively flat cross sectional profile designed to maximize mutual penetration of the interlocked edge and lip.

16. Seaming equipment of claim 7, including means for lowering said spindle in the area of said orbit where the assembly of the cover and the cylindrical body is replaced.

17. Seaming equipment of claim 7, further comprising a meshing gear pair including an internal gear rigidly fixed to a frame of said equipment and a shaft gear keyed to said spindle, and said internal gear having longer teeth to balance an axial shaft of said spindle.

18. Seaming equipment for interlocking the rims of a metal container including a cylindrical body enclosed at opposite ends by respective covers, e.g. a can utilized for food stuffs, comprising:

arcuate die means disposed on an arc about a center for engaging the rim and the cover of a container;

a single vertical column, rotatable about its own axis;

a plurality of spindles carried by said column each having a vertical axis disposed substantially in radial formation;

at least two working areas arranged around said column; and one roller associated with each of said spindles, each roller being carried by a relative support rotatable as one with said column about the vertical axis of sad column and capable of movement together with said roller, through the agency of actuator means which are fixed in relation to said column, between a first position in which said roller remains distanced from an interlocking cylindrical body edge and cover lip and the cylindrical body is currently occupying said spindle, and a second position in which the roller enters into contact with the interlocked edge and lip and exerts a compressive and compacting force against said spindle.

19. Seaming equipment of claim 18, further comprising:

a cam follower, connected via said support with said roller, said cam follower being biased by spring means into actuator means which are formed like a cam and rigidly attached to a frame of said equipment, said actuator means controlling the distance of said roller to the axis of said spindle.

* * * * *